US009368856B2

(12) United States Patent
Lee

(10) Patent No.: US 9,368,856 B2
(45) Date of Patent: Jun. 14, 2016

(54) WINDOW ASSEMBLY FOR DISPLAY DEVICE WITH ANTENNA AND METHOD OF MANUFACTURING THE SAME

(71) Applicant: SAMSUNG DISPLAY CO., LTD., Yongin, Gyeonggi-Do (KR)

(72) Inventor: Hyun Jae Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 280 days.

(21) Appl. No.: 13/958,504

(22) Filed: Aug. 2, 2013

(65) Prior Publication Data

US 2014/0232609 A1 Aug. 21, 2014

(30) Foreign Application Priority Data

Feb. 19, 2013 (KR) ..... 10-2013-0017642

(51) Int. Cl.

| | |
|---|---|
| ***H01Q 1/42*** | (2006.01) |
| ***H01P 11/00*** | (2006.01) |
| ***H01Q 1/24*** | (2006.01) |
| ***H01Q 1/44*** | (2006.01) |

(52) U.S. Cl.

CPC ..... *H01P 11/00* (2013.01); *H01Q 1/243* (2013.01); *H01Q 1/44* (2013.01); *Y10T 29/49016* (2015.01)

(58) Field of Classification Search

CPC ..... H01Q 1/243; H01Q 1/42
USPC ..... 343/702, 872, 873; 29/600
See application file for complete search history.

(56) References Cited

U.S. PATENT DOCUMENTS

| | | | | |
|---|---|---|---|---|
| 5,729,241 | A * | 3/1998 | Ergen | H01Q 1/42 343/704 |
| 6,903,698 | B2 * | 6/2005 | Silva | H01Q 1/1271 343/713 |
| 8,091,208 | B2 * | 1/2012 | Finn | G06K 19/07327 29/592.1 |
| 2009/0213027 | A1 * | 8/2009 | Finn | G06K 19/07327 343/866 |
| 2013/0021215 | A1 * | 1/2013 | Suzuki | B29C 45/14 343/787 |
| 2014/0361931 | A1 * | 12/2014 | Irci | H01Q 1/243 343/702 |

FOREIGN PATENT DOCUMENTS

| | | | | |
|---|---|---|---|---|
| KR | 2008053054 | A * | 6/2008 | H04B 1/38 |
| KR | 10-2010-0062539 | A | 6/2010 | |
| KR | 10-2010-0118350 | A | 11/2010 | |
| KR | 10-2010-0124954 | A | 11/2010 | |

* cited by examiner

*Primary Examiner* — Tho G Phan
(74) *Attorney, Agent, or Firm* — Lewis Roca Rothgerber Christie LLP

(57) ABSTRACT

A window assembly for a display device with an antenna includes a cover window, an antenna pattern, an insulating layer, and an antenna pad. The cover window includes a receiving recess having a bottom surface with a concavo-convex shape. The antenna pattern is accommodated in the receiving recess to cover the bottom surface and the antenna pattern has a lower surface with a concavo-convex shape corresponding to the concavo-convex shape of the bottom surface. The insulating layer is accommodated in the receiving recess to cover the antenna pattern. The antenna pad is disposed on the insulating layer and electrically coupled to the antenna pattern. Thus, a volume of the antenna pattern is increased, and a radiation capability of the antenna may be improved.

16 Claims, 6 Drawing Sheets

WINDOW ASSEMBLY FOR DISPLAY DEVICE WITH ANTENNA AND METHOD OF MANUFACTURING THE SAME

CROSS-REFERENCE TO RELATED APPLICATION

This application claims priority to and the benefit of Korean Patent Application No. 10-2013-0017642, filed on Feb. 19, 2013, the content of which is hereby incorporated by reference in its entirety.

BACKGROUND

1. Field

The present disclosure relates to a window assembly for a display device with an antenna and a method of manufacturing the same.

2. Description of the Related Art

In recent years, a display device, in which an antenna receiving a broadcast signal is built, has become popular. The display device includes a display panel, a cover window, and an antenna pattern. The cover window is disposed on the display panel to protect a front surface of the display panel from external impacts. The antenna pattern is disposed between the display panel and the cover window.

Generally, because each of the cover window and the display panel has a flat plate shape, the whole thickness of the display device increases by a thickness of the antenna pattern. In addition, when the thickness of the antenna pattern decreases in order to reduce the whole thickness of the display device, the capability (e.g., radiation capability) of the antenna is degraded.

SUMMARY

Aspects of embodiments of the present invention are directed toward a window assembly employing an antenna having improved radiation capability and improved impact resistance without increasing the thickness of the window assembly.

Aspects of embodiments of the present invention are directed toward a window assembly for a display device with an antenna capable of improving a radiation capability of the antenna built therein and a method of manufacturing the window assembly.

Embodiments of the present invention provide a window assembly for a display device with an antenna, including: a cover window that includes a receiving recess having a bottom surface with a concavo-convex shape; an antenna pattern accommodated in the receiving recess to cover the bottom surface, the antenna pattern having a lower surface with a concavo-convex shape corresponding to the concavo-convex shape of the bottom surface; an insulating layer accommodated in the receiving recess to cover the antenna pattern; and an antenna pad disposed on the insulating layer and electrically coupled to the antenna pattern.

The window assembly may further include a feeding electrode, wherein the insulating layer may be provided with a via hole formed therethrough to overlap with the antenna pattern and the antenna pad when viewed in a plan view, and the feeding electrode may be disposed in the via hole to electrically couple the antenna pattern with the antenna pad.

The bottom surface may include a concave portion and a convex portion, and a height difference between the concave portion and the convex portion may be smaller than a height difference between an upper surface of the cover window and the concave portion.

The antenna pattern may include: a radiating member overlapped with the concave portion when viewed in a plan view; and a connection pattern overlapped with the convex portion, when viewed in a plan view and coupled to the radiating member.

The radiating member may have a thickness greater than a thickness of the connection pattern.

An upper surface of the antenna pattern may be flat.

The antenna pattern may be provided along an upper surface of the concave portion, an upper surface of the convex portion, and a concavo-convex side surface that couples the concave portion with the convex portion.

The antenna pattern may have a uniform thickness.

An upper surface of the antenna pattern may have a concavo-convex shape.

The window assembly may further include a coupling pattern electrically coupled to the antenna pad and coupling with the antenna pattern to apply a signal to the antenna pattern without physically making contact with the antenna pattern.

According to an embodiment of the present invention, there is provided a window assembly for a display device with an antenna, including: a cover window that includes a receiving recess having a bottom surface with a concavo-convex shape; a first antenna pattern accommodated in the receiving recess to cover the bottom surface, the first antenna pattern having a lower surface with a concavo-convex shape corresponding to the concavo-convex shape of the bottom surface; a first insulating layer accommodated in the receiving recess to cover the first antenna pattern; a second antenna pattern disposed on the first insulating layer and electrically coupled to the first antenna pattern; a second insulating layer that covers the second antenna pattern; and an antenna pad disposed on the second insulating layer and electrically coupled to at least one of the first antenna pattern or the second antenna pattern.

The window assembly may further include a first feeding electrode, wherein the first insulating layer includes a first via hole formed therethrough, the first via hole overlapping with the first antenna pattern and the second antenna pattern, wherein the first feeding electrode may be disposed in the first via hole to electrically couple the first antenna pattern with the second antenna pattern.

The window assembly may further include a second feeding electrode, wherein the first and second insulating layers include a second via hole formed therethrough, the second via hole overlapping with the first antenna pattern and the second antenna pattern, wherein the second feeding electrode may be disposed in the second via hole to electrically connect the first antenna pattern with the second antenna pattern.

The bottom surface may include a concave portion and a convex portion, and a height difference between the concave portion and the convex portion may be less than a height difference between an upper surface of the cover window and the concave portion.

The first antenna pattern may include: a radiating member overlapped with the concave portion when viewed in a plan view; and a connection pattern overlapped with the convex portion when viewed in a plan view and coupled to the radiating member, wherein the radiating member may have a thickness greater than a thickness of the connection pattern.

According to an embodiment of the present invention, there is provided a method of manufacturing a window assembly for a display device, the method including: forming a cover window that includes a receiving recess having a bottom surface; and forming an antenna module in the receiving recess.

The forming of the cover window may include: preparing a window substrate having a flat-plate shape; and removing a portion of the window substrate to form the receiving recess having the bottom surface with a concavo-convex shape.

The forming of the cover window may include: preparing a window substrate having a flat-plate shape; removing a portion of the window substrate to form the receiving recess having the bottom surface that may be flat; and forming a protrusion pattern on the bottom surface that may be flat.

The protrusion pattern may include a transparent insulating material.

The forming of the cover window may include: preparing a window substrate having a flat-plate shape; removing a portion of the window substrate to form the receiving recess having a bottom surface that may be flat; and attaching a mold pattern on the bottom surface, which may be formed by an injection molding method to have a concavo-convex shape on an upper surface thereof.

The forming of the antenna module may include: forming an antenna pattern on the bottom surface of the receiving recess; forming an insulating layer on the antenna pattern; forming a feeding electrode to allow the feeding electrode to be coupled to the antenna pattern after penetrating through the insulating layer; and forming an antenna pad to be coupled to the feeding electrode.

The antenna module may be attached to the bottom surface of the receiving recess after being separately assembled.

BRIEF DESCRIPTION OF THE DRAWINGS

The above and other aspects of the present invention will become readily apparent by reference to the following detailed description when considered in conjunction with the accompanying drawings wherein.

DETAILED DESCRIPTION

Figure 1:
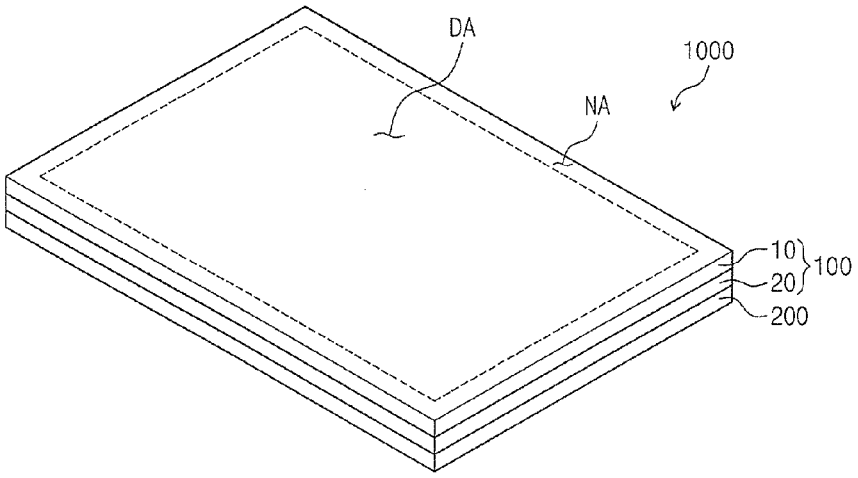
FIG. 1 is a perspective view showing a display device, according to an example embodiment of the present invention.

It will be understood that when an element or layer is referred to as being "on", "connected to" or "coupled to" another element or layer, it can be directly on, connected to, or coupled to the other element or layer, or intervening element(s) or layer(s) may be present. In contrast, when an element is referred to as being "directly on," "directly connected to" or "directly coupled to" another element or layer, there are no intervening elements or layers present. Like numbers refer to like elements throughout the following. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer, or section from another component, region, layer, or section. Thus, a first element, component, region, layer, or section discussed below could be termed a second element, component, region, layer or section without departing from the teachings of the present invention.

Spatially relative terms, such as "beneath," "below," "lower," "above," "upper," and the like, may be used herein for ease of description to describe the relationship of one element or feature with other element(s) or feature(s) as illustrated in the figures. It will be understood that the spatially relative terms are intended to encompass different orientations of the device in use or operation in addition to the orientation depicted in the figures. For example, if the device in the figures is turned over, element(s) described as "below" or "beneath" other element(s) or feature(s) would then be oriented "above" the other element(s) or feature(s). Thus, the example term "below" can encompass both an orientation of above and below. The device may be otherwise oriented (rotated 90 degrees or at other orientations) and the spatially relative descriptors used herein are interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "comprises", "comprising", "includes" and "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in more detail with reference to the accompanying drawings.

FIG. 1 is a perspective view showing a display device 1000, according to an example embodiment of the present invention.

Referring to FIG. 1, the display device 1000 includes a display panel 100 and a window assembly 200.

The display panel 100 may be one of various suitable display panels, such as an organic light emitting display panel, a liquid crystal display panel, a plasma display panel, an electrophoretic display panel, an electrowetting display panel, etc. In the present example embodiment, the organic light emitting display panel will be described as the display panel 100.

The display panel 100 includes a display area DA in which an image is displayed and a non-display area NA disposed adjacent to the display area DA.

The display panel 100 includes a first substrate 10 and a second substrate 20. The first substrate 10 includes a plurality of pixels arranged in matrix form in the display area DA. In addition, the first substrate 10 further includes a gate driver and a data driver, which are used to drive the pixels. The first substrate 10 further includes a pad electrode and an integrated circuit chip, which are disposed in the non-display area NA. The integrated circuit chip is mounted on the first substrate 10 in a chip-on-glass (COG) manner to be electrically coupled to the pad electrode.

The second substrate 20 is coupled to the first substrate 10 to seal the pixels, circuits, and lines, which are disposed on the first substrate 10, from the outside thereof. Although not shown in figures, the display panel 100 may further include a polarizing film attached on the second substrate 20 to prevent an external light from being reflected.

Figure 2:
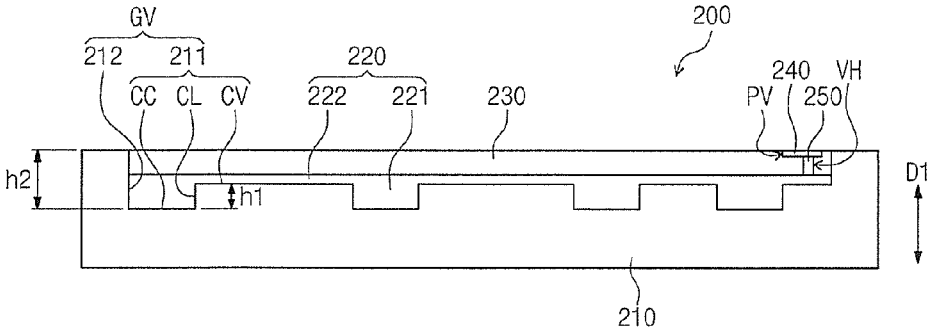
FIG. 2 is a cross-sectional view showing a window assembly of the display device shown in FIG. 1, according to an example embodiment of the present invention.

FIG. 2 is a cross-sectional view showing a window assembly of the display device shown in FIG. 1, according to an example embodiment of the present invention.

Referring to FIGS. 1 and 2, the window assembly 200 covers a front surface of the display panel 100 displaying the image. That is, the window assembly 200 is disposed to face the first substrate 10 with the second substrate 20 interposed therebetween. The window assembly 200 includes an upper surface and a lower surface, which are flat.

The window assembly 200 includes a cover window 210, an antenna pattern 220, an insulating layer 230, and an antenna pad 240.

The cover window 210 protects the display panel 100 and accommodates other elements of the window assembly 200. The cover window 210 is formed of a transparent material, e.g., glass or plastic.

The cover window 210 includes a receiving recess GV. The receiving recess GV includes a bottom surface 211 and a side surface 212 coupled to the bottom surface 211.

The bottom surface 211 has a concavo-convex shape. The bottom surface 211 includes a concave portion CC, a convex portion CV, and a concavo-convex side surface CL. The concave portion CC is located (or positioned) at a relatively lower position than that of a peripheral portion thereof in a first direction D1, and the convex portion CV is located at a relatively higher position than that of a peripheral portion thereof in the first direction D1. The concave portion CC and the convex portion CV are coupled to each other by the concave-convex side surface CL extended in the first direction D1.

The cover window 210 has a thickness in the concave portion CC, which is smaller than a thickness of the convex portion CV thereof. The concave portion CC and the convex portion CV have a height difference h1 therebetween, and the concavo-convex side surface CL has a height equal to the height difference h1 between the concavo portion CC and the convex portion CV.

The height difference h1 between the concave portion CC and the convex portion CV is smaller than a height difference h2 between the upper surface of the cover window 210 and the concave portion CC. That is, the thickness of the cover window 210 is the greatest in the area in which the receiving recess GV does not exist.

The antenna pattern 220 is accommodated in the receiving recess GV and covers the bottom surface 211.

The antenna pattern 220 includes a radiating member 221 and a connection pattern 222. The radiating member 221 is overlapped with the concave portion CC when viewed in a plan view (or from above). The phrase "plan view" will be interpreted herein as a vertical orthographic projection of an object on to a horizontal plane. The connection pattern 222 is overlapped with the convex portion CV when viewed in a plan view and coupled to the radiating member 221.

The radiating member 221 has a thickness thicker than a thickness of the connection pattern 222 in the first direction D1. A height difference between the radiating member 221 and the connection pattern 222 in the first direction D1 is equal to the height difference h1 between the concave portion CC and the convex portion CV. Accordingly, when assuming that the radiating member 221 and the connection pattern 222 have the same area when viewed in a plan view, the radiating member 221 has a volume greater than a volume of the connection pattern 222.

An upper surface of the antenna pattern 220 may be a flat surface. In addition, a lower surface of the antenna pattern 220 has a concavo-convex shape corresponding to the bottom surface 211 of the receiving recess GV.

The antenna pattern 220 is overlapped with a portion of the display area DA when viewed in a plan view. The antenna pattern 220 is formed of a transparent metal, such as indium tin oxide (ITO), and thus the image displayed in the display panel 100 may transmit through the antenna pattern 220.

Figure 3:
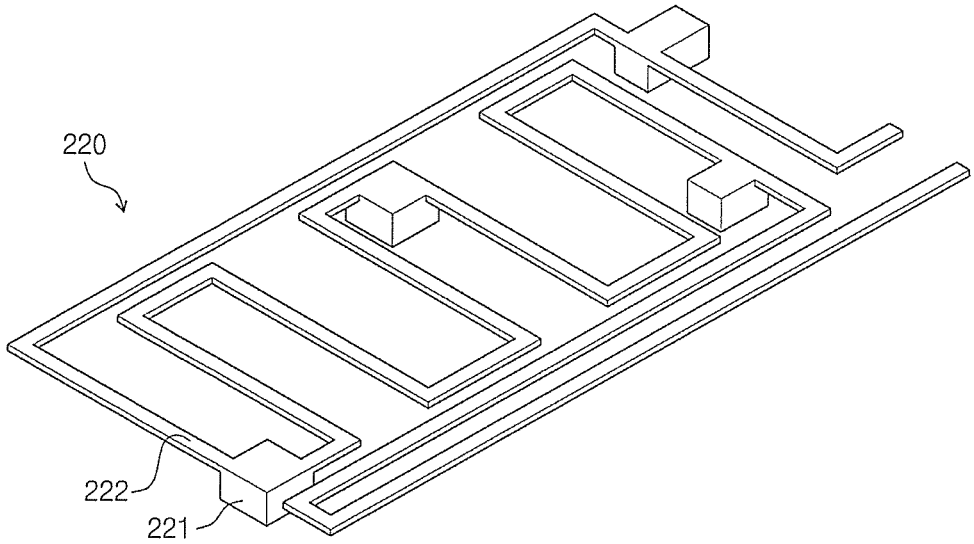
FIG. 3 is a perspective view showing an antenna pattern of the window assembly shown in FIG. 2, according to an example embodiment of the present invention.

FIG. 3 is a perspective view showing the antenna pattern of the window assembly shown in FIG. 2, according to an example embodiment of the present invention.

Referring to FIG. 3, the antenna pattern 220 includes a plurality of radiating members 221 and the connection pattern 222 having a spiral shape, but it should not be limited thereto or thereby. That is, the antenna pattern 220 may have various suitable shapes.

Referring to FIG. 2 again, the insulating layer 230 is accommodated in the receiving recess GV and disposed on the antenna pattern 220. The insulating layer 230 covers the antenna pattern 220 when viewed in a plan view, and thus the antenna pattern 220 is isolated from the outside thereof.

The insulating layer 230 may be formed of a transparent insulating material. Thus, the insulating layer 230 does not exert influence on the radiation capability of the antenna pattern 220, and the image displayed in the display panel 100 transmits through the insulating layer 230.

The insulating layer 230 is filled in the receiving recess GV to allow the upper surface of the window assembly 200 to be flat. Accordingly, a sum of the thickness of the antenna pattern 220 adjacent to the side surface 212 of the receiving recess GV and a thickness of the insulating layer 230 may be equal to the height of the side surface of the receiving recess GV.

The insulating layer 230 is provided with a pattern recess PV overlapped with the non-display area NA. In addition, the insulating layer 230 is provided with a via hole VH formed through a portion corresponding to the pattern recess PV to expose a portion of the upper surface of the antenna pattern 220.

The antenna pad 240 is accommodated in the pattern recess PV. The antenna pad 240 is electrically coupled to a broadcast signal receiver disposed outside the window assembly 200. The antenna pad 240 is disposed to overlap with the non-display area NA when viewed in a plan view.

The window assembly 200 may further include a feeding electrode 250. The via hole VH is located at a position overlapping with the antenna pattern 220 and the antenna pad 240 when viewed in a plan view. The feeding electrode 250 is disposed in the via hole VH to electrically connect the antenna pattern 220 and the antenna pad 240. The broadcast signal received through the antenna pad 240 is applied to the antenna pattern 220 through the feeding electrode 250.

In a comparable display device including a window assembly with an antenna pattern, the antenna pattern has a thin film shape. That is, the antenna pattern is formed by attaching a film or coating a material, and thus the antenna pattern has a uniform thickness. In addition, because the cover window has a plate shape and the antenna pattern is disposed on the cover window, the whole thickness of the window assembly increases. Further, when the insulating layer that covers the antenna pattern is thinly formed in order to reduce the thickness of the window assembly, the antenna pattern becomes susceptible to damage by external impacts.

According to an embodiment of the present invention, in the display device 1000 including the window assembly 200 and the antenna pattern 220, the antenna pattern 220 has a volume greater than that of the comparable antenna pattern. For example, when the thickness of the connection pattern 220 shown in FIG. 2 is equal to the thickness of the comparable antenna pattern, the volume of the antenna pattern 220 is greater than that of the comparable antenna pattern because the radiating member 221 has a thickness greater than the thickness of the connection pattern 222. In general, the capability (e.g., radiation capability) of the antenna is improved as the volume of the antenna pattern increases, and thus the display device, according to the present example embodiment, may improve the capability of the antenna when compared to the comparable display device.

In addition, according to the display device 1000, because the antenna pattern 220 and the insulating layer 230 are accommodated in the receiving recess GV of the cover window 210, the whole thickness of the window assembly 200 may be more reduced than the comparable display device. Further, because the insulating layer 230 may have a thickness greater than that of the comparable insulating layer when the depth of the receiving recess GV is increased, the antenna pattern 220 may become less susceptible to damage from external impacts.

Figure 4:
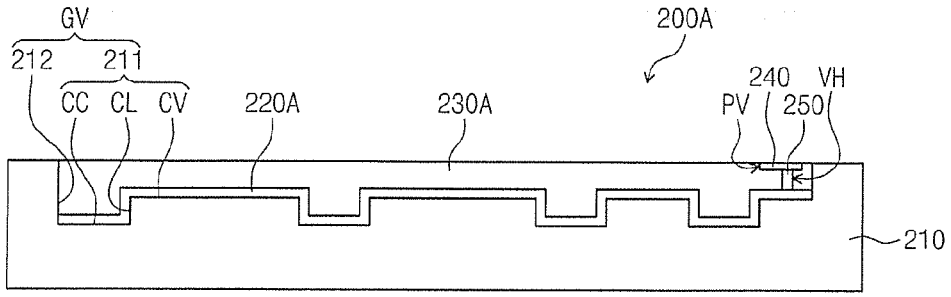
FIG. 4 is a cross-sectional view showing a window assembly, according to another example embodiment of the present invention.

FIG. 4 is a cross-sectional view showing a window assembly 200A, according to another example embodiment of the present invention.

The window assembly 200A has the same structure and function as those of the window assembly 200 except for the antenna pattern and the insulating layer. In FIG. 4, the same reference numerals denote the same elements in FIG. 2, and thus detailed descriptions of the same elements will not be provided.

Referring to FIG. 4, an antenna pattern 220A is accommodated in the receiving recess GV and disposed on the bottom surface 211. The antenna pattern 220A is formed to have the same thickness on the concave portion CC, the convex portion CV, and the concavo-convex side surface CL. An upper surface of the antenna pattern 220A has a concavo-convex shape to correspond to the bottom surface 221.

An insulating layer 230A is accommodated in the receiving recess GV and disposed on the antenna pattern 220A. The insulating layer 230A covers the antenna pattern 220A when viewed in a plan view, and thus the antenna pattern 220A is isolated from the outside thereof. In addition, the insulating layer 230A planarizes the upper surface of the antenna pattern 220A. Accordingly, the upper surface of the window assembly 200 becomes flat by the insulating layer 230A.

According to the display device of the present example embodiment, because the antenna pattern 220A is formed along the bottom surface 211 of the receiving recess GV, the antenna pattern 220A may have a volume greater than that of the antenna pattern formed on a comparable cover window having a flat plate shape. For example, although the antenna pattern 220A according to the present example embodiment, and the antenna pattern according to the comparable antenna pattern, have the same shape when viewed in a plan view, the antenna pattern 220A may have a volume greater than that of the comparable antenna pattern because the antenna pattern 220A is disposed on the concavo-convex side surface CL. Thus, the display device, according to the present example embodiment, may improve the capability (e.g., radiation capability) of the antenna when compared to the comparable display device.

Figure 5:
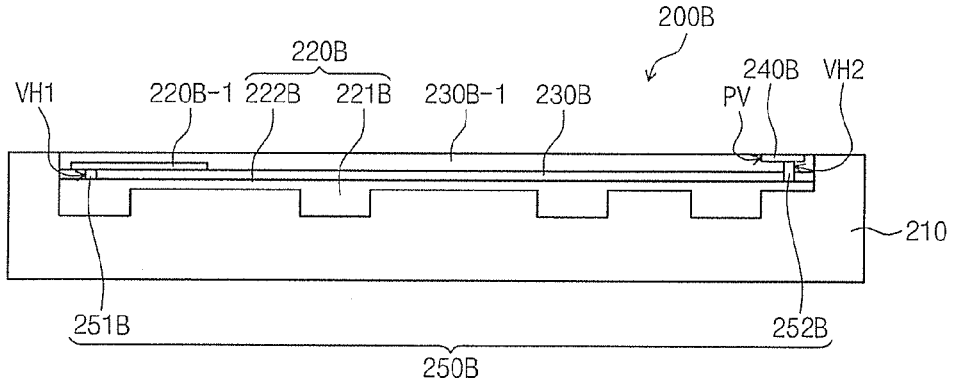
FIG. 5 is a cross-sectional view showing a window assembly, according to another example embodiment of the present invention.

FIG. 5 is a cross-sectional view showing a window assembly 200B, according to another example embodiment of the present invention.

The window assembly 200B has the same structure and function as those of the window assembly 200 except for elements accommodated in the receiving recess GV. In FIG. 5, the same reference numerals denote the same elements in FIG. 2, and thus detailed descriptions of the same elements will not be provided.

Referring to FIG. 5, the window assembly 200B includes a cover window 210, a first antenna pattern 220B, a first insulating layer 230B, a second antenna pattern 200B-1, a second insulating layer 230B-1, an antenna pad 240B, and feeding electrode 250B. The first antenna pattern 220B, the first insulating layer 230B, the second antenna pattern 220B-1, the second insulating layer 230B-1, the antenna pad 240B, and the feeding electrode 250B are accommodated in the receiving recess GV of the cover window 210.

The first antenna pattern 220B is substantially the same as the antenna pattern 220 shown in FIG. 2, and thus detailed description of the first antenna pattern 220B will not be provided. The first antenna pattern 220B includes a radiating member 221B and a connection pattern 222B.

The first insulating layer 230B is disposed on the first antenna pattern 220B. The first insulating layer 230B covers the first antenna pattern 220B when viewed in a plan view to isolate the first antenna pattern 220B from the outside thereof. The first insulating layer 230B is formed of a transparent insulating material. Thus, the first insulating layer 230B does not exert influence on (e.g., adversely affect) the radiation capability of the first antenna pattern 220B and the second antenna pattern 220B-1, and the image displayed in the display panel 100 (refer to FIG. 1) transmits (or is visible) through the first insulating layer 230B.

The first insulating layer 230B is provided with a first via hole VH1 formed therethrough to expose a portion of an upper surface of the first antenna pattern 220B. In one embodiment, the first via hole VH1 is overlapped with the first antenna pattern 220B and the second antenna pattern 220B-1 when viewed in a plan view.

The second antenna pattern 220B-1 is disposed on the first insulating layer 230B. In one embodiment, the second antenna pattern 220B-1 is overlapped with a portion of the first antenna pattern 220B when viewed in a plan view. The second antenna pattern 220B-1 is electrically coupled to the first antenna pattern 220B and assists a function of the first antenna pattern 220B. The second antenna pattern 220B-1 may be formed of the same material as the first antenna pattern 220B.

The second insulating layer 230B-1 is disposed on the second antenna pattern 220B-1 and the first insulating layer 230B. The second insulating layer 230B-1 covers the second antenna pattern 220B-1 to isolate the second antenna pattern 220B-1 from the outside thereof and planarizes the upper surface of the window assembly 200B.

The second insulating layer 230B-1 includes a pattern recess PV formed therein and is overlapped with the non-display area NA (refer to FIG. 1). In addition, the first insulating layer 230B and the second insulating layer 230B-1 include a second via hole VH2 formed therethrough to expose a portion of the upper surface of the first antenna pattern 220B. The second via hole VH2 is overlapped with the pattern recess PV.

The antenna pad 240B is disposed in the pattern recess PV. The antenna pad 240B is electrically coupled to a receiving terminal of a broadcast signal receiver. The antenna pad 240B is disposed to overlap with the non-display area NA when viewed in a plan view.

The feeding electrode 250B may include a first feeding electrode 251B and a second feeding electrode 252B.

The first feeding electrode 251B is disposed in the first via hole VH1 to electrically connect the first antenna pattern 220B and the second antenna pattern 220B-1.

The second feeding electrode 252B is disposed in the second via hole VH2 to electrically couple (or electrically connect) the first antenna pattern 220B and the antenna pad 240B. The broadcast signal received through the antenna pad 240B is applied to the first antenna pattern 220B and the second antenna pattern 220B-1 through the second feeding electrode 252B.

According to the display device of the present example embodiment, the antenna pattern has a multi-layer structure, so that the volume of the antenna pattern becomes larger than that of the antenna pattern of the display device shown in FIG. 1. Therefore, the display device of the present example embodiment may achieve the same effect as (or improve upon the radiation capability of) the display device shown in FIG. 1.

Figure 6:
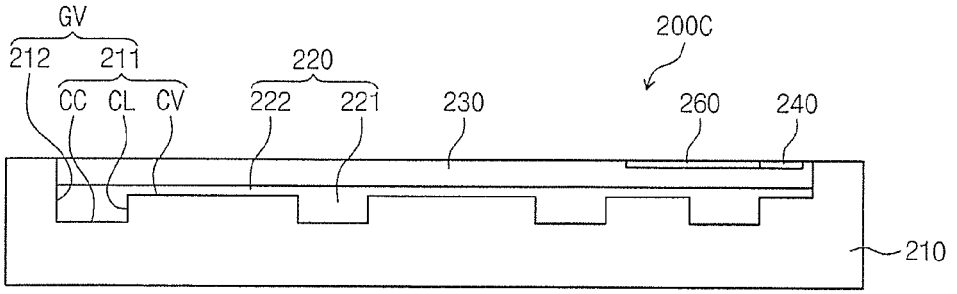
FIG. 6 is a cross-sectional view showing a window assembly, according to another example embodiment of the present invention.

FIG. 6 is a cross-sectional view showing a window assembly, according to another example embodiment of the present invention. The window assembly 200C has the same structure and function as those of the window assembly 200 except for a feeding electrode and a coupling pattern 260. In FIG. 6, the same reference numerals denote the same elements in FIG. 2, and thus detailed descriptions of the same elements will not be provided.

Referring to FIG. 6, the window assembly 200C includes the coupling pattern 260.

As shown in FIG. 2, the antenna pattern 220 of the window assembly 200 receives the broadcast signal from the antenna pad 240 through the feeding electrode 250. However, the antenna pattern 220 of the window assembly 200C shown in FIG. 6 receives the broadcast signal from the antenna pad 240 through the coupling pattern 260. The coupling pattern 260 is coupling with the antenna pattern 220, and thus coupling pattern 260 applies the broadcast signal to the antenna pattern 220 without physically making contact with the antenna pattern 220.

The coupling pattern 260 is coupled to the antenna pad 240 and disposed on the same layer as the antenna pad 240. In addition, the coupling pattern 260 is insulated from the antenna pattern 220, but it should not be limited thereto or thereby. That is, the coupling pattern 260 may be integrally formed with the antenna pad 240, and the antenna pad 240 may be disposed on the coupling pattern 260 to make contact with the coupling pattern 260.

The coupling pattern 260 has a size and a shape set in consideration of a frequency of a wireless signal used in the display device.

Figure 7:
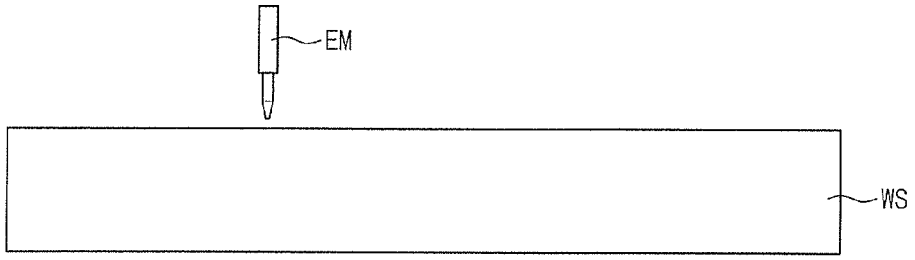
FIGS. 7 to 9 are cross-sectional views showing a method of manufacturing the window assembly shown in FIG. 2, according to an example embodiment of the present invention.
Figure 8:
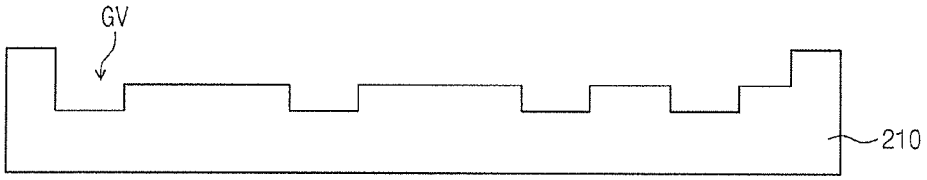
Figure 9:
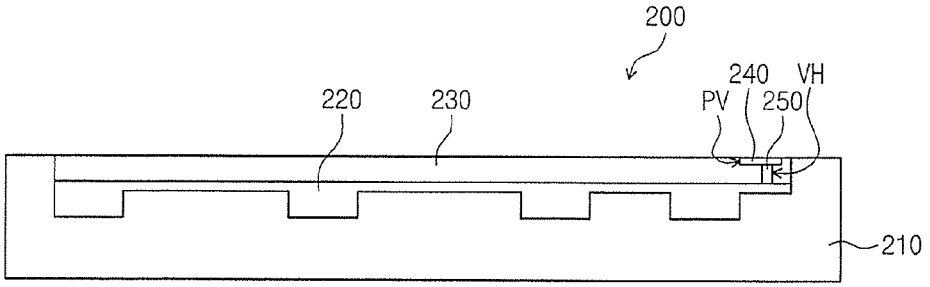

FIGS. 7 to 9 are cross-sectional views showing a method of manufacturing the window assembly shown in FIG. 2, according to an example embodiment of the present invention.

Referring to FIG. 7, a window substrate WS is prepared in a flat-plate shape. The window substrate WS is formed of a transparent material, such as glass, plastic, etc.

Then, the window substrate WS is engraved with an engraving machine EM to form a cover window 210. The cover window 210 includes the receiving recess having the bottom surface on which the concavo-convex shape is formed by the engraving process. The bottom surface having the concavo-convex shape determines the shape of the antenna pattern. In more detail, a CAD data related to the shape of the antenna pattern is input into the engraving machine EM, and the engraving machine EM engraves the window substrate WS in accordance with the CAD data. The CAD data includes information about the shape of the antenna pattern, which is determined in consideration of a wireless frequency used in the display device, a transmitting and receiving electrical power of the display device, and impedance of the wireless frequency signal.

However, the process of forming the bottom surface of the window substrate WS should not be limited to the engraving process. For example, the bottom surface of the window substrate WS may be formed by using an etching process.

As a result, the cover window 210 in which the receiving recess GV is formed is formed as shown in FIG. 8.

Referring to FIG. 9, an antenna module is formed in the receiving recess GV.

The antenna module includes the antenna pattern 220, the insulating layer 230, the antenna pad 240, and the feeding electrode 250.

For example, the antenna pattern 220 is formed on the bottom surface of the receiving recess GV. The antenna pattern 220 is formed by depositing a conductive material. In addition, the antenna pattern 220 may be formed by coating or spraying a conductive ink or a conductive polymer on the bottom surface of the receiving recess GV and curing the conductive ink or polymer. In such an embodiment, the thickness and material of the antenna pattern 220 may be changed according to efficiency and capability (e.g., radiation capability) of the antenna.

Then, the insulating layer 230 is formed on the antenna pattern 220. The insulating layer 230 is formed of a transparent insulating material.

The insulating layer 230 is partially etched or engraved to form the pattern recess PV therein. The pattern recess PV is formed to overlap with the non-display area NA shown in FIG. 1. The pattern recess PV is formed by partially removing the insulating layer 230 in a thickness direction of the insulating layer 230, and thus the antenna pattern 220 is not exposed through the pattern recess PV.

After that, the via hole VH is formed penetrating through the insulating layer 230. The via hole VH is located at a position overlapped with the pattern recess PV when viewed in a plan view. The portion of the upper surface of the antenna pattern 220 is exposed through the via hole VH.

The feeding electrode 250 is formed using the conductive material in the via hole VH.

The antenna pad 240 is formed in the pattern recess PV using the conductive material. The antenna pad 240 is electrically coupled to the antenna pattern 220 by the feeding electrode 250.

Meanwhile, the antenna module may be attached to the receiving recess GV after being separately manufactured. That is, the antenna pattern 220, the insulating layer 230, the antenna pad 240, and the feeding electrode 250 may be provided as a single antenna module after they are assembled together. To this end, an adhesive layer is formed (e.g., deposited) on the bottom surface of the receiving recess GV, and then the assembled antenna module is attached to the receiving recess GV. The adhesive layer is formed of a transparent insulating material to prevent (or reduce) any adverse effect on the radiation capability of the antenna pattern 220. For instance, the adhesive layer may be an ultraviolet ray curing resin or an adhesive tape.

Figure 10:
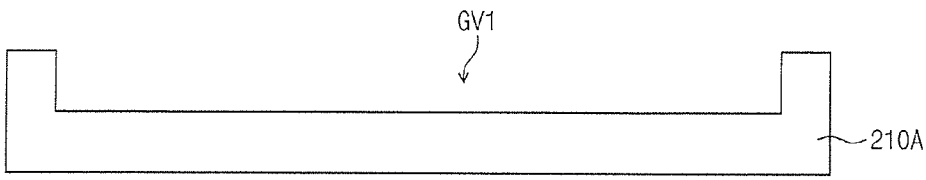
FIGS. 10 to 12 are cross-sectional views showing a method of manufacturing the window assembly shown in FIG. 2, according to another example embodiment of the present invention.
Figure 11:
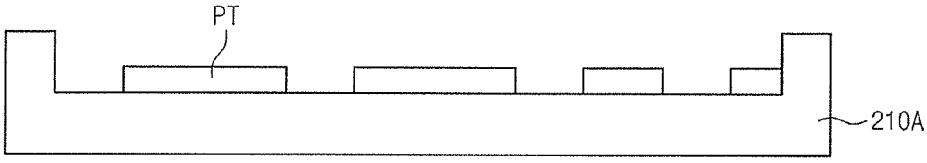
Figure 12:
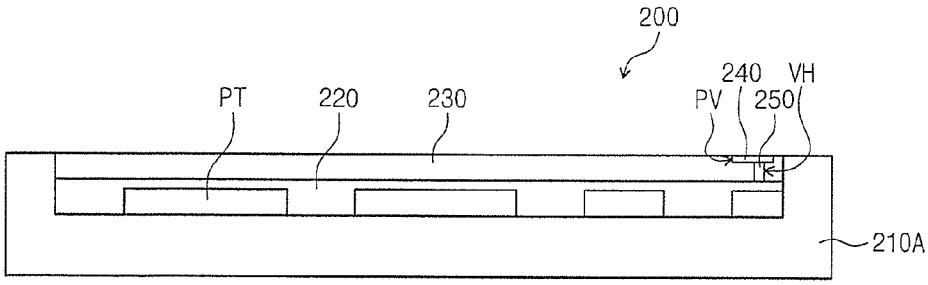

FIGS. 10 to 12 are cross-sectional views showing a method of manufacturing the window assembly shown in FIG. 2, according to another example embodiment of the present invention.

The method shown in FIGS. 10 to 12 is the same as the method described with reference to FIGS. 7 to 9 except for the forming of the window cover, and thus, the following discussion will mainly focus on the difference between the method shown in FIGS. 10 to 12 and the method shown in FIGS. 7 to 9.

Referring to FIG. 10, a window substrate is prepared in a flat-plate shape. The window substrate is formed of a transparent material, such as glass, plastic, etc. Then, the window substrate is etched or engraved to form a recess GV1 having a bottom surface that is flat. FIG. 10 shows the cover window 210A including the recess GV1 having the flat bottom surface.

Referring to FIG. 11, a protrusion pattern PT is formed on the flat bottom surface. The protrusion pattern PT may have the same shape as the convex portion CV shown in FIG. 2. The protrusion pattern PT has a height smaller than that of a side surface of the recess GV1. The protrusion pattern PT is formed of a transparent insulating material.

The protrusion pattern PT is formed by printing the insulating material on the bottom surface of the recess GV1, depositing the insulating material on the bottom surface of the recess GV1, or attaching the insulating material on the bottom surface of the recess GV1 using an adhesive.

Then, as shown in FIG. 12, the antenna module is formed on the bottom surface of the recess GV1 on which the protrusion pattern PT is formed.

Figure 13:
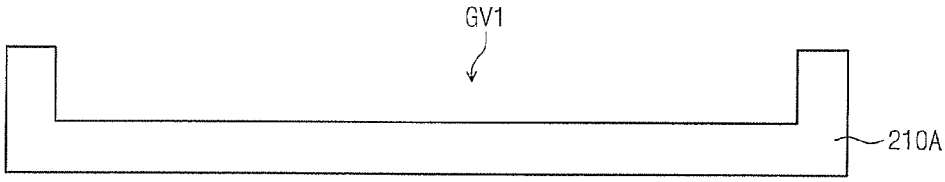
FIGS. 13 to 15 are cross-sectional views showing a method of manufacturing the window assembly shown in FIG. 2, according to another example embodiment of the present invention.
Figure 14:
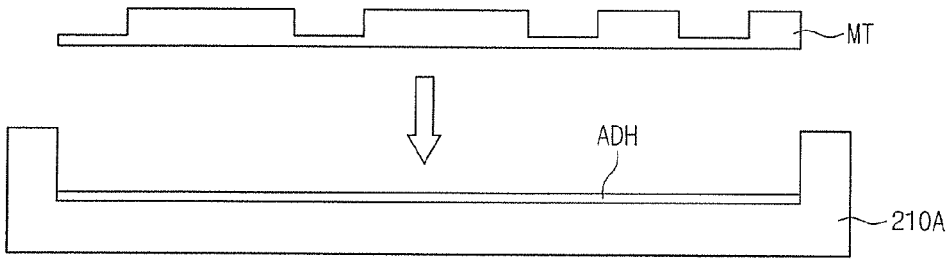
Figure 15:
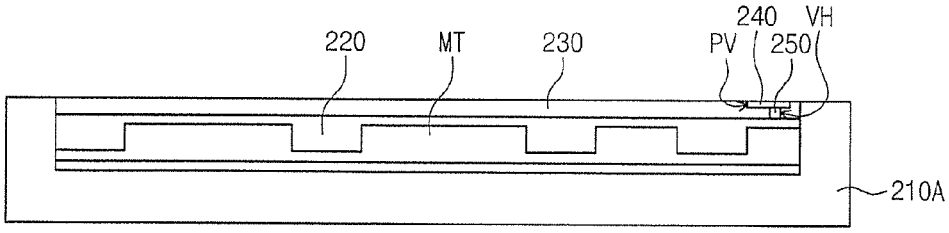

FIGS. 13 to 15 are views showing a method of manufacturing the window assembly shown in FIG. 2, according to another example embodiment of the present invention. The method shown in FIGS. 13 to 15 is the same as the method described with reference to FIGS. 7 to 9 except for the forming of the window cover, and thus the following discussion will mainly focus on the difference between the method shown in FIGS. 13 to 15 and the method shown in FIGS. 7 to 9.

Referring to FIG. 13, a window substrate is prepared in a flat-plate shape. The window substrate is formed of a transparent material, such as glass, plastic, etc. Then, the window substrate is etched or engraved to form a recess GV1 having a bottom surface that is flat. FIG. 13 shows the cover window 210A including the recess GV1 having the flat bottom surface.

Referring to FIG. 14, a mold pattern MT, which is formed by, for example, an injection molding method, is attached to the bottom surface of the recess GV1. An upper surface of the mold pattern MT has a concavo-convex shape, and a lower surface of the mold pattern MT has a flat shape. The mold pattern MT is attached to the bottom surface of the recess GV1 after an adhesive layer ADH is formed on the bottom surface of the recess GV1. The adhesive layer ADH is formed of a transparent insulating material to prevent (or reduce) any adverse effect on the radiation capability of the antenna pattern 220. For instance, the adhesive layer ADH may be an ultraviolet ray curing resin or an adhesive tape.

Then, the antenna module is formed on the mold pattern MT as shown in FIG. 15.

Although several example embodiments of the present invention have been described, it is understood that the present invention should not be limited to these example embodiments and that various changes and modifications can be made by one of ordinary skill in the art while staying within the spirit and scope of the present invention as provided in the appended claims, and equivalents thereof.

What is claimed is:

1. A window assembly for a display device with an antenna, comprising:

a cover window that comprises a receiving recess having a bottom surface with a concavo-convex shape;

an antenna pattern accommodated in the receiving recess to cover the bottom surface, the antenna pattern having a lower surface with a concavo-convex shape corresponding to the concavo-convex shape of the bottom surface;

an insulating layer accommodated in the receiving recess to cover the antenna pattern; and an antenna pad disposed on the insulating layer and electrically coupled to the antenna pattern, a feeding electrode, wherein the insulating layer is provided with a via hole formed therethrough to overlap with the antenna pattern and the antenna pad when viewed in a plan view, and the feeding electrode is disposed in the via hole to electrically couple the antenna pattern with the antenna pad.

2. The window assembly of claim 1, wherein the bottom surface comprises a concave portion and a convex portion, and a height difference between the concave portion and the convex portion is smaller than a height difference between an upper surface of the cover window and the concave portion.

3. The window assembly of claim 2, wherein the antenna pattern comprises:

a radiating member overlapped with the concave portion when viewed in a plan view; and a connection pattern overlapped with the convex portion, when viewed in a plan view and coupled to the radiating member.

4. The window assembly of claim 3, wherein the radiating member has a thickness greater than a thickness of the connection pattern.

5. The window assembly of claim 4, wherein an upper surface of the antenna pattern is flat.

6. The window assembly of claim 2, wherein the antenna pattern is provided along an upper surface of the concave portion, an upper surface of the convex portion, and a concavo-convex side surface that couples the concave portion with the convex portion.

7. The window assembly of claim 6, wherein the antenna pattern has a uniform thickness.

8. The window assembly of claim 7, wherein an upper surface of the antenna pattern has a concavo-convex shape.

9. The window assembly of claim 1, further comprising a coupling pattern electrically coupled to the antenna pad and coupling with the antenna pattern to apply a signal to the antenna pattern without physically making contact with the antenna pattern.

10. A window assembly for a display device with an antenna, comprising:

a cover window that comprises a receiving recess having a bottom surface with a concavo-convex shape;

a first antenna pattern accommodated in the receiving recess to cover the bottom surface, the first antenna pattern having a lower surface with a concavo-convex shape corresponding to the concavo-convex shape of the bottom surface;

a first insulating layer accommodated in the receiving recess to cover the first antenna pattern;

a second antenna pattern disposed on the first insulating layer and electrically coupled to the first antenna pattern;

a second insulating layer that covers the second antenna pattern; and an antenna pad disposed on the second insulating layer and electrically coupled to at least one of the first antenna pattern or the second antenna pattern.

11. The window assembly of claim 10, further comprising a first feeding electrode, wherein the first insulating layer comprises a first via hole formed therethrough, the first via hole overlapping with the first antenna pattern and the second antenna pattern, wherein the first feeding electrode is disposed in the first via hole to electrically couple the first antenna pattern with the second antenna pattern.

12. The window assembly of claim 10, further comprising a second feeding electrode, wherein the first and second insulating layers comprise a second via hole formed therethrough, the second via hole overlapping with the first antenna pattern and the second antenna pattern, wherein the second feeding electrode is disposed in the second via hole to electrically connect the first antenna pattern with the antenna pad.

13. The window assembly of claim 10, wherein the bottom surface comprises a concave portion and a convex portion, and a height difference between the concave portion and the convex portion is less than a height difference between an upper surface of the cover window and the concave portion.

14. The window assembly of claim 13, wherein the first antenna pattern comprises:

a radiating member overlapped with the concave portion when viewed in a plan view; and a connection pattern overlapped with the convex portion when viewed in a plan view and coupled to the radiating member, wherein the radiating member has a thickness greater than a thickness of the connection pattern.

15. The window assembly of claim 13, wherein the antenna pattern is formed of a transparent metal.

16. A display panel comprising:

a display panel configure to output an image; and a window assembly configured to transmit the image, wherein the window assembly comprises:

a cover window that comprises a receiving recess having a bottom surface with a concavo-convex shape;

an antenna pattern accommodated in the receiving recess to cover the bottom surface, the antenna pattern having a lower surface with a concavo-convex shape corresponding to the concavo-convex shape of the bottom surface;

an insulating layer accommodated in the receiving recess to cover the antenna pattern; and an antenna pad disposed on the insulating layer and electrically coupled to the antenna pattern, a feeding electrode to electrically couple the antenna pattern with the antenna pad, wherein the insulating layer is provided with a via hole formed therethrough to overlap with the antenna pattern and the antenna pad when viewed in a plan view, and the feeding electrode is disposed in the via hole.

* * * * *